US006593289B1

(12) United States Patent
Stavrakas

(10) Patent No.: US 6,593,289 B1
(45) Date of Patent: Jul. 15, 2003

(54) LIQUID FABRIC SOFTENER FORMULATIONS COMPRISING HEMICYANINE RED COLORANTS

(75) Inventor: James E. Stavrakas, Greenville, SC (US)

(73) Assignee: Milliken & Co., Spartenburg, SC (US)

( * ) Notice: Subject to any disclaimer, the term of this patent is extended or adjusted under 35 U.S.C. 154(b) by 0 days.

(21) Appl. No.: 10/047,050

(22) Filed: Jan. 15, 2002

(51) Int. Cl.[7] ..... C11D 7/26; C11D 7/32

(52) U.S. Cl. ..... 510/516; 510/500; 510/504; 510/506; 510/527

(58) Field of Search ..... 510/500, 504, 510/506, 516, 527

(56) References Cited

U.S. PATENT DOCUMENTS

| | | | | | |
|---|---|---|---|---|---|
| 4,137,180 | A | | 1/1979 | Naik et al. | 252/8.8 |
| 4,198,316 | A | * | 4/1980 | Nahta | 252/354 |
| 4,368,053 | A | * | 1/1983 | Eckhardt et al. | 8/102 |
| 4,767,547 | A | | 8/1988 | Straathof et al. | 252/8.8 |
| 4,877,411 | A | | 10/1989 | Hines et al. | 8/403 |
| 5,089,148 | A | | 2/1992 | Van Blarcom et al. | 252/8.6 |
| 5,130,035 | A | | 7/1992 | Dell' Armo et al. | 252/8.6 |
| 5,183,580 | A | | 2/1993 | Lew et al. | 252/8.6 |
| 5,204,010 | A | | 4/1993 | Klewsaat | 252/8.75 |
| 5,207,933 | A | | 5/1993 | Trinh et al. | 252/8.6 |
| 5,290,475 | A | | 3/1994 | Wixon | 252/174.23 |
| 5,332,513 | A | | 7/1994 | Doms et al. | 252/8.6 |
| 5,534,405 | A | | 7/1996 | Moriarty et al. | 435/5 |
| 6,066,432 | A | | 5/2000 | Yanaka | 430/203 |

* cited by examiner

*Primary Examiner*—Gregory Delcotto
(74) *Attorney, Agent, or Firm*—Terry T. Moyer; William S. Parks

(57) ABSTRACT

Fabric softener compositions comprising certain red colorants that exhibit excellent deep, dark red colorations (for aesthetic purposes) and mix very well with other colorants to provide differing red shades and tints therein, which simultaneously exhibit very low, if any staining capabilities on fabrics treated therewith, are provided. Such deep and dark red colorations have heretofore been unavailable within fabric softener formulations due to the tendency of such prior colorants to exhibit unacceptable staining levels, particularly when formulated at similar deep and dark shades as now provided within the inventive low-staining formulations. Apparently, and quite unexpectedly, the colorants present therein react favorably with quaternary ammonium salt softening agents in a manner to prevent reaction with the fibers of the treated fabrics themselves, thereby preventing staining thereon and therein. Such novel red-colored or -tinted fabric softener formulations, as well as any other quaternary-ammonium salt-containing red-colored or -tinted compositions are encompassed within this invention.

20 Claims, No Drawings

LIQUID FABRIC SOFTENER FORMULATIONS COMPRISING HEMICYANINE RED COLORANTS

FIELD OF THE INVENTION

This invention relates to fabric softener compositions comprising certain red colorants that exhibit excellent deep, dark red colorations (for aesthetic purposes) and mix very well with other colorants to provide differing red shades and tints therein, which simultaneously exhibit very low, if any staining capabilities on fabrics treated therewith. Such deep and dark red colorations have heretofore been unavailable within fabric softener formulations due to the tendency of such prior colorants to exhibit unacceptable staining levels, particularly when formulated at similar deep and dark shades as now provided within the inventive low-staining formulations. Apparently, and quite unexpectedly, the colorants present therein interact favorably with quaternary ammonium salt softening agents in a manner to prevent reaction with the fibers of the treated fabrics themselves, thereby preventing staining thereon and therein. Such novel red-colored or -tinted fabric softener formulations, as well as any other quaternary-ammonium salt-containing red-colored or -tinted compositions are encompassed within this invention.

DISCUSSION OF THE PRIOR ART

All U.S. and foreign patents cited within this specification are hereby incorporated by reference.

Fabric softeners have been provided as colored formulations for aesthetic reasons and brand identity. Although white and/or clear compositions have been commercialized in the past as well, the modem consumer often prefers attractively colored cleaning, etc., products.

Fabric softener compositions are known in the art and are used in rinse cycles of automatic laundry operations to impart improved hand and anti-static properties to laundered fabrics. The first U.S. concentrated (6–10% active) rinse cycle fabric softener was introduced in the 1960s. These were added during the final rinse of the wash cycle and were usually quaternary types, mainly di(hydrogenated) tallow dimethylammonium chloride (DHTDMAC), although some were based on imidazoline or amido amine derivatives. The products were essentially aqueous solutions or suspensions containing 4–6% active softener, a fabric substantive fragrance and a viscosity modifier.

In 1990, ultra formulations, (17–28% solids), e.g., "triple concentrates," were introduced in the U.S. and are increasing in the marketplace owing to their reduced packaging and transportation costs. Such formulations require particular care in ingredient formulation, mixing, viscosity control, and final formulation viscosity stability in order to provide stable, low viscosity products. See, e.g., "Formulation and Production of Concentrated Rinse Cycle Fabric Softeners," Robert 0. Keys, happi/March 1995, pp. 95–97, and "Fabric Conditioning Agents," George R. Whalley, happi/February 1995, pp. 55–58. Recently, formulations have reduced or replaced DHTDMAC, e.g., by ester quats or ester amines, in order to facilitate product breakdown in the ecosystem, particularly in Europe. These formulations also require special considerations to provide a commercial product of the proper viscosity.

Colorants are generally added to liquid fabric softening compositions for visual appeal to the consumer as well as identity of the product. Fabric staining caused by softener compositions can be permanent; however, initial staining may not always be obvious to the consumer due to potentially and relatively low levels of discoloration during individual laundry cycles. Thus, staining may actually accumulate on target fabrics over a period of time rather than during a single wash.

Colorants employed in fabric softener compositions are preferably those which are easily removed from fabric if color staining, or possibly staining due to softener compounds themselves, occurs. Such colorants thus must exhibit a very low and reduced tendency to stain commonplace fabrics such as cotton and polyester. Dyes of high color stability in the fabric softener compositions which exhibit minimal complexation or reaction with other fabric softener ingredients and the laundered fabrics themselves are of particular interest in fabric softener composition applications. Among these dyes are certain polymer-bound colorants which are available from Milliken Chemical Co. as Liquitint® colorants whose incorporation in liquid fabric softening compositions is noted in published international application WO 94/10285 as well as direct dyes, acid dyes, F,D & C Dyes (e.g., Red 40), rhodamines, pigments, and the like, which impart red colorations to liquid softener formulations, but also have a tendency to stain targeted fabrics, particularly when present at levels that provide deep and dark red shades. To date, red colorants providing deep and dark red shades, specifically at high L, c, and h values as noted below, within fabric softening compositions have been unavailable to the industry without also exhibiting unacceptable staining levels.

As alluded to above, it is desirable, to provide aesthetically pleasing red colorations for liquid fabric softener compositions, wherein the colorants are stable in low pH (e.g., from about 1 to 4) cationic compound-containing liquid formulations, non-staining, and capable of high color loading and bright coloration without precipitating out of the composition. In particular, colorants are desired which provide an increase in the ease of stain removal versus the aforementioned commonly used red colorants and dyes within liquid fabric softener compositions. The red colorants traditionally introduced within liquid fabric softener formulations simply cannot provide the low staining properties with simultaneously the aforementioned aesthetically desirable deep and dark red shades or, alternatively, the ability to thoroughly mix with other colorants to provide pink or reddish shades or tints within the target liquid composition. Such traditional colorants (e.g., acid dyes, pigments, etc.) unfortunately were difficult to incorporate within the low-pH cationic formulations common with liquid fabric softeners. Apparently, such colorants cannot achieve the desired color space characteristics without also exhibiting unacceptably high stain levels on certain fabric substrates. As such, there remains a need to provide such aesthetically useful, non-staining colorations within liquid fabric softeners.

DESCRIPTION OF THE INVENTION

It is thus an object of the invention to provide a liquid fabric softener composition which is brightly colored through the utilization of at least one water-soluble non-staining red colorant. It is another object of this invention to provide a red colorant that mixes thoroughly with other colorants within liquid fabric softener formulations to permit production of different brightly colored shades of pink, orange, violet, or, of course, red therein, while simultaneously exhibiting essentially no staining of target fabrics contacted therewith during an aqueous rinse of a standard laundry procedure (e.g., either by hand or within a tumble, rotary, or other type of washing machine). A further object of the invention is to provide a liquid fabric softener formulation that will not exhibit any appreciable staining on target substrates and thus only provides red colorations within and to the target liquid fabric softener composition. Yet another object of this invention is to provide a red colorant that provides color in the presence of cationic softener compounds but will not appreciably react with fiber constituents of target fabrics. Accordingly, this invention is directed to a fabric softener composition comprising at least one fabric softening component and at least one red colorant that provides excellent high color space characteristics and exhibits a simultaneously low tendency to stain target fabrics, as well as the use of such compositions for conditioning fabrics in an aqueous wash. More particularly, this invention relates to a liquid fabric softener composition comprising a hemicyanine colorant, preferably having an electrophilic reactive group reacted with a poly (oxyallylene)-containing moiety having a nucleophilic reactive group to provide a polymeric colorant.

The present invention thus encompasses a liquid fabric softener composition comprising at least one cationic fabric softener compound and at least one water-soluble red hemicyanine derivative colorant, preferably a polymeric derivative of such a colorant, either as the sole colorant to provide a red hue, or as a component within a mixture of colorants to provide.any number of different hues. Alternatively, this invention encompasses a liquid fabric softener composition comprising at least one cationic fabric softener compound and at least one red colorant, wherein said liquid fabric softener composition exhibits a red color characterized by a color space in terms of CIELAB values under D65 illumination of an L* value of at least 30, an a* value of at least 20, a b* value of between −20 and 20, a C* value of at least 20, and an h° of between 0 and 30° and 300° and 360, wherein said red-colored liquid fabric softener exhibits a stain level of at least 4 upon contact with a 100% terry cotton fabric substrate pursuant to the AATCC Gray Scale For Evaluating Staining. Furthermore, this invention encompasses a red colorant that exhibits a color space in terms of CIELAB values under D65 illumination of an L* value of at least 30, an a* value of at least 20, a b* value of between −20 and 20, a C* value of at least 20, and an h° of between 0 and 30° and 300° and 360, and exhibits a stain level of at least 4 upon contact with a 100% terry cotton fabric substrate pursuant to the AATCC Gray Scale For Evaluating Staining when present within a liquid composition comprising at least 3% by weight of a specific quaternary ammonium cationic fabric softener compound (either Accosoft® 501 or 808, as listed below). Lastly, this invention encompasses a method of treating fabrics within a rinse cycle of a standard laundering method within a rotary washing machine comprising the steps of a) providing a liquid fabric softener composition as discussed above; b) providing at least one target fabric substrate within said rotary washing machine; and c) introducing, at a point in time after said at least one target fabric substrate has been subjected to a cleaning stage within a standard laundering process within said rotary washing machine, preferably during the rinse cycle of said process, said liquid fabric softener in an amount sufficient to impart softening characteristics to said target fabric.

The inventive colorants have unexpectedly been found to function very well in solution with low pH, cationic fabric softener compounds. To that end, such colorants have been found to provide the above-delineated highly desirable color space characteristics to permit deep and dark red colorations within target liquid fabric softener formulations. Furthermore, such colorants, being polymeric in nature, preferably, exhibit very low, if no, staining properties of fabrics when utilized in combination with such cationic softener compounds. Thus, such fabrics as cotton, polyester, poly/cotton blends, nylon, and the like, can be treated (such as, for example, during the rinse cycle of a standard rotary laundering procedure) with liquid fabric softeners comprising such red colorants and not exhibit any appreciable staining caused thereby. Such colorants are thus very compatible with the cationic (e.g., for example, quatenary ammonium) compounds required of such fabric softener compositions, and also exhibit compatibility with standard fragrances and preservatives, as merely examples, without complexing or destabilizing the resultant mixture. The inventive colorants can withstand the presence of quaternary ammonium compounds (as well as the associated pH levels imparted thereby, particularly between 1 and 4) and thus can be utilized in any liquid media comprising quaternary ammonium compounds, primarily, as noted throughout, fabric softener compositions, but also, to a lesser but possible extent, certain cleaning solutions, antistatic sprays, and the like. Lastly, since the inventive colorants produce true solutions and not emulsions nor dispersions, the formulations made therefrom are homogeneous (not clear) and brilliant in appearance, and can easily mix with other colorants, including traditional red colorants (as well as others) to form different non-staining colorations, shades, tints, etc. (such as pink, orange, purple, and the like), within target formulations.

The inventive colorants and thus formulations made therewith also exhibit excellent light fastness, particularly over a long shelf life. The color space values will generally not become modified over time and upon exposure to standard fluorescent or incandescent lighting such that the desired colorations are retained for long periods of time.

Preferably, as noted above, the particular hemicyanine derivative colorant is polymeric in nature, and most preferably comprises poly(oxyalkylene) pendants groups thereon. Such poly(oxyalkylene) groups are selected from polyethyleneoxy (EO), polypropyleneoxy (PO), and polybutyleneoxy (BO) groups, although longer chain monomers may also be utilized (up to about 18 carbons, for example). Preferably these moieties are all EO groups, although combinations of EO and any of the others may be utilized as well. Preferably from about 2 to about 200 moles of alkyleneoxy groups are present on each separate polyoxyalkylene pendant group; more preferably from about 2 to 50 moles; and still more preferably from about 5 to 25 moles, and most preferably about 20 moles. The term "polyoxyalkylene" is intended to encompass any pendant group that includes at least two alkyleneoxy moieties.

The addition of polyoxyalkylene groups to the hemicyanine base compound may be accomplished through the reaction of a poly(oxyalkenylated) aniline aldehyde with Fisher's Base to form the needed conjugated system to produce colorations in the visible spectrum as well as the desired polymeric species. Such a reaction is described in greater detail below.

The preferred hemicyanine is most easily understood through the representation of the following formula (I)

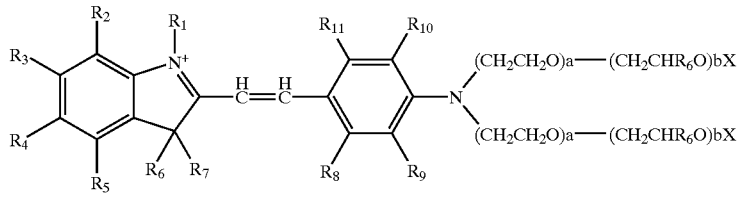

Hemicyanine Polymeric Colorant wherein $R_1$ is H or $C_1$–$C_{20}$ alkyl; $R_2$, $R_3$, $R_4$, $R_5$, $R_6$, $R_7$, $R_8$, $R_9$, $R_{10}$, and $R_{11}$ are the same or different and are selected from the group consisting of H, $C_1$–$C_{20}$ alkyl, $C_1$–$C_{20}$ alkoxy, $C_1$–$C_{20}$ hydroxyl, amino, hydroxyl, and $C_1$–$C_{20}$ carboxyl; R' is $C_1$–$C_{16}$ alkyl; a is 0–200 and b is 0–200, wherein a+b≧3; X is H or $COCH_3$; and any counter ion may be present, such as, without limitation, OH_, $Cl^-$, $CH_3COO^-$, or $HSO_4^-$. Preferably, through not necessarily, such a compound is present wherein $R_1$ and $R_6$ are methyl and the remaining R groups are hydrogen, and further wherein a is about 20, b is 0, X is $COCH_3$, and the counter ion is $OH^-$.

The only previous utilizations of hemicyanine type colorants to any great extent have been in the fields of fugitive yarn colorants, as in U.S. Pat. No. 4,877,411 to Hines et al., which permit color to be temporarily applied to target yarns for identification purposes, or film development, apparently to provide certain hues within the finished picture, such as taught within U.S. Pat Nos. 5,534,405 to Nishigaki et al., and U.S. Pat No. 6,066,432 to Yanaka. No teachings have been provided of liquid formulations of such types of colorants, let alone polymeric derivatives thereof, in combination with quaternary ammonium compounds or cationic fabric softeners, within the pertinent art to provide an effectively colored liquid formulation which does not exhibit appreciable coloring or staining of target fabrics upon treatment therewith.

Preferably, the water soluble polymeric hemicyanine derivative colorants are liquid in nature at ambient temperature and pressure and at substantial purity; however, pasty or waxy colorants (which are readily soluble in water) are also encompassed within this invention and may be added to fabric softener formulations, particularly in combination with viscosity modifying agents (such as, without limitation, calcium chloride) to provide the desired viscosity level (of between about 10 to about 1,500 cps to permit sufficient pourability). The term ambient temperature and pressure means from about 20 to about 25° C. at a pressure of from about 0.8 to about 1.2 atmospheres. Furthermore, substantial purity means that the colorant is at least 90% free from solvent, diluent, surfactant, and any other compound which may dilute the colorant compound. The target inventive compositions will include at least one cationic, preferably quaternary ammonium, fabric softener compound, as well as other standard softener additives, such as resins, preservatives, pH adjusters, foam depressants, antistatic compounds, enzymes, bactericides, fungicides, stabilizers, and the like, in addition to at least colorant as defined above. However, these additive compounds do not factor into the measure of the liquid state of the target colorants of this invention and are merely required within the inventive compositions upon production thereof.

Such inventive compositions may comprise any type of fabric softening formulations and compounds. Formulations of suitable fabric softener compositions of the present invention except the colorant are disclosed in U.S. Pat. No. 5,183,580 to Lew et al., U.S. Pat. No. 5,207,933 to Trinh et al., U.S. Pat. No. 5,204,010 to Klewsaat, U.S. Pat. No. 5,290,475 to Wixon, U.S. Pat. No. 5,130,035 to Dell'Armo et al., and U.S. Pat. No. 5,089,148 to Van Blarcom et al. The liquid fabric softener composition of the present invention would include from about 3 to about 50% by weight of the total composition, preferably from 15 to about 35% by weight of a cationic fabric-softening compound, preferably a quaternary ammonium compound. The counter ion may be a halide, such as fluoride, chloride, bromide, or iodide. Other counter ions may be employed such as methylsulfate, ethylsulfate, hydroxide, acetate, formate, sulfate, carbonate, and the like. Preferably, the counter ion is chloride or methylsulfate, chloride being especially preferred for liquid fabric conditioning compositions of the present invention. Generally, concentrated liquid fabric softener compositions of the present invention can contain 17% to 50% solids (diluted with major amounts of water, either deionized or tap in nature). Particulate fabric softening compositions of the present invention can be prepared according to the formulation set out in U.S. Pat. No. 5,332,513 to Doms et al.

Examples of cationic quaternary ammonium salts include, but are not limited to:

(1) Acyclic quaternary ammonium salts having at least two $C_{8-30}$, preferably $C_{12-22}$ alkyl chains, such as: ditallowdimethyl ammonium chloride (Adogen® from Sherex), di(hydrogenated tallow) dimethyl ammonium chloride (Adogen 442® from Sherex), distearyldimethyl ammonium chloride (Arosurf TA-1000® from Sherex), dicocodimethyl ammonium chloride (Variquat K300® from Sherex), methyl bis (tallowamido ethyl)-2-hydroxyethyl ammonium methyl sulfate (Accosoft® 501 from Stepan Chemical), and the like;

(2) Cyclic quaternary ammonium salts of the imidazolinium type such as di(hydrogenated tallow)-dimethyl imidazolinium chloride, 1-ethylene-bis(2-tallow-1-methyl) imidazolinium chloride (Varisoft 6112® from Sherex), methyl (1) tallow amidoethyl (2) tallow imidazolinium methyl sulfate (Accosoft® 808 from Stepan Company), and the like;

(3) Diamido quaternary ammonium salts such as: methylbis(hydrogenated tallow amidoethyl)-2-hydroxyethyl ammonium methylsulfate (Varisoft 110® from Sherex), methyl-bis(tallowamidoethyl)-2-hydroxypropyl ammonium methylsulfate (Varisoft 238® from Sherex), and the like;

(4) Biodegradable quaternary ammonium salts such as N,N-di(tallowoyl-oxy-ethyl)-N,N-dimethyl ammonium chloride and N,N-di(tallowoyl-oxy-propyl)-N,N-dimethyl ammonium chloride.

When fabric conditioning compositions employ biodegradable quaternary ammonium salts, the pH of the composition is adjusted to between about 2 and 7, preferably from 3 to about 5. Biodegradable ammonium salts are described more fully in U.S. Pat. Nos. 4,767,547 and 4,789,491.

Biodegradable cationic diester compounds may be employed of the type which have the formula:

$$(R^2C(O)OCH_2)R^2C(O)OCHCH_2N^+R_3X^-$$

wherein each R is a short chain $C_{1-6}$, preferably $C_{1-3}$, alkyl or hydroxyalkyl group, e.g., methyl (most preferred), ethyl, propyl, hydroxyethyl, and the like, benzyl, or mixtures thereof; each $R^2$ is a long chain $C_{10-22}$ hydrocarbyl, or substituted hydrocarbyl substituent, preferably $C_{15-19}$ alkyl and/or alkylene, most preferably $C_{15-17}$ straight chain alkyl and/or alkylene; and the counter ion, $X^-$, can be any softener-compatible anion, for example, chloride, bromide, methylsulfate, formate, sulfate, nitrate, and the like. These cationic diesters are described in greater detail in U.S. Pat. No. 4,137,180.

The fabric softening compositions of the present invention comprise a water carrier, up to 5% by weight of the total composition organic solvents, such as lower alcohols, which can improve handling, fluidity, and viscosity. From 3 to about 50% by weight of the total composition comprise the active softening compounds discussed above. Preferably, the fabric softeners are acyclic quaternary ammonium salts with ditallowdimethyl ammonium chloride being the most preferred. Also included within these compositions may be other non-cationic fabric conditioning agents such as tertiary fatty amines, reaction products of stearic acid and aminoethylethanolamine, carboxylic acids having from 8 to 30 carbon atoms and one carboxylic acid group per molecule esters of polyhydric alcohols such as sorbitan esters or glyceryl stearate, fatty alcohols, ethoxylated fatty alcohols, alkylphenols, ethoxylated alkylphenols, ethoxylated fatty amines, ethoxylated monoglycerides, ethoxylated diglycerides, ethoxylated fatty amines, mineral oils, and polyols, such as polyethylene glycol. Furthermore, pH adjusters should be added to adjust the pH of the inventive fabric softening composition to below about 7.0, preferably in the range of 4 to about 6.5. If necessary, any acidic material may be utilized to perform this function, such as hydrochloric acid, citric acid, maleic acid, and the like.

The inventive colorant is added in an amount from about 0.001 to about 3.0% by weight of the total composition; preferably from about 0.003 to about 1.0%; more preferably from about 0.01 to about 0.1%; and most preferably from about 0.015 to about 0.05%. Other additives may be present in amounts from about 0.1 to about 30% by weight of the total composition in order to provide increased softening performance, composition stability, viscosity modifications, dispersibility, and soil release. These additives include silicones, predominantly polydimethylsiloxanes; soil release polymers such as block copolymers of polyethylene oxide and terephthalate fatty amines; amphoteric surfactants; smectite clays; anionic soaps; zwitterionic surfactants; and nonionic surfactants. Such surfactants and soaps mirror those discussed above in the cleaning compositions. Additionally, polymer additives may be present, such as guar gum, polyethylene oxide, and cyclodextrin. Electrolytes may also be added for viscosity control in amounts up to about 5% by weight of the total composition. Such electrolytes include calcium chloride, magnesium chloride, sodium chloride, and other Group IA and IIA halides, as well as alkylene polyammonium salts.

Preservatives, such as glutaraldehyde and formaldehyde may also be added, as well as emulsifiers, opacifiers, anti-shrink agents, anti-wrinkle agents, fabric crisping agents, spotting agents, antioxidants, anti-corrosion agents, optical brighteners, buffers, perfumes, germicides, bactericides, and bacteriostatic agents.

Liquid fabric softening compositions encompassed within this invention can be prepared through standard techniques. For example, a softening active premix is prepared at 50–80° C., to which is added, with stirring, hot water. The colorant can then be added at any time after the preparation of this mixture while temperature-sensitive compounds must be added at certain times during the cooling down period. Preferably, the colorant is added to the hot water prior to addition to the premix.

Such liquid compositions can thus be utilized in the rinse cycle of a standard home laundry operation. As noted above, the red colorants of this invention unexpectedly provide effective non-staining even when present as very deep and dark red colorations therein the target formulations. Also, the red colorants may be mixed with other types of colorants, including acid dyes, other polymeric colorants, pigments, and the like, to produce different colorations or shades within target softener formulations.

As noted previously, color space is extremely important to impart the desired dark and deep red colorations needed for aesthetic purposes. Such desired color space for the target red colorants of this invention provide, at wavelengths commensurate with the visible red range, from as low as about 495 nm (for reddish-orange colorations) to about 550 nm (for reddish-purple colorations)(generally, specific red colorations are difficult to delineate with perfect consistency, and, as the ordinarily skilled artisan would understand, such a broad range above (e.g., 495–500 nm) covers most, if not all, reddish colors, while red itself falls between about 510 and 520 nm), characteristics mathematically defined by measuring the individual components of the equation:

$$E^*=((L^*)^2+(a^*)^2+(b^*)^2)^{1/2}$$

wherein E* represents the total color measurement of either the liquid formulation comprising cationic compound and red colorant, or the red colorant itself. L*, a*, and b* are the color coordinates; wherein L* is a measure of the lightness and darkness of the formulation or colorant (with 0 being blackest and 100 being whitest); a* is a measure of the redness or greenness of the formulation or colorant; and b* is a measure of the yellowness or blueness of the formulation or colorant. A further measurement, defined as h°, measures the hue of the sample in terms of the angle ranging from 0 to 360 degrees, wherein the first 90 degrees represents colors of red, yellow, and orange; the next 90 degrees are yellow, yellow-green, and green; from 180 to 270 degrees, green, cyan, and blue; and above 270, blue, purple, magenta, purple, violet, and a return to red colors. Another measurement, C*, is utilized to define the chroma (saturation) of a sample, with brightness shown through a distance further from the base axis (e.g., a higher C* measurement indicates a brighter color). For a further discussion and explanation of this testing procedure, see Billmeyer, F. W., et al., *Principles of Color Technology*, 2nd Edition, pp. 62–64 and 10.1–04, or Fundamentals of Color and Appearance, Section 2, in particular pages 2.12–2.14, both herein entirely incorporated by reference. Such measurements must exhibit sufficiently high brightness and redness levels, as well as a proper red hue angle and bright chroma (and thus low blueness and yellowness), in order to provide the darkest and deepest red shades possible within the target softener formulations. Of course, as noted throughout, the ultimate formulation may exhibit colorations different from those within the visible red range, such as pink, orange, and/or violet, as examples (and thus exist as mixtures of the desired colorant with other effective coloring agents). However, such differently colored formulations should still comprise at least one of the above-defined hemicyanine red colorants to provide very effective and dark and deep shades of these other colors in mixture with other standard colorants. Furthermore, the non-staining propensity of such polymeric hemicyanines reduces the chances of staining on target fabrics treated with such differently colored fabric softener formulations as well.

Thus, the preferred red colorant, and thus the preferred red-colored fabric softener formulation, should exhibit CIELAB values under D65 illumination of an L* value of at least 30, an a* value of at least 20, a b* value of between −20 and 20, a C* value of at least 20, and an h° of between 300° and 30° (the higher the L* value, the brighter the color; the higher the a* value, the redder the color; the lower the b* value, the less blue the color; the higher the C*, the brighter the color), when measured by color spectrophotometer in reflectance mode using a D65 incandescent light source, and at a 10 degree observation perspective. The closest art teaches red colorants that do not exhibit such required levels of color space, or which can exhibit such high levels but only when present in amounts within the target fabric softener formulation that cause staining levels on target fabrics that are highly unacceptable. As such, the specifically dark and deep red colorations provided by the hemicyanines of this invention are unexpected and beneficial, and attain color space levels heretofore unavailable while also exhibiting very low tendencies to stain. Again, the attainment of such a specific colorant would provide excellent bright and deep colors and effective mixtures with other colorants for the purposes of providing different hues and shades within the target fabric softener (or other low pH, cationic compound-containing) formulation.

DESCRIPTION OF THE PREFERRED EMBODIMENT

The general method of making the preferred inventive colorant is as follows:

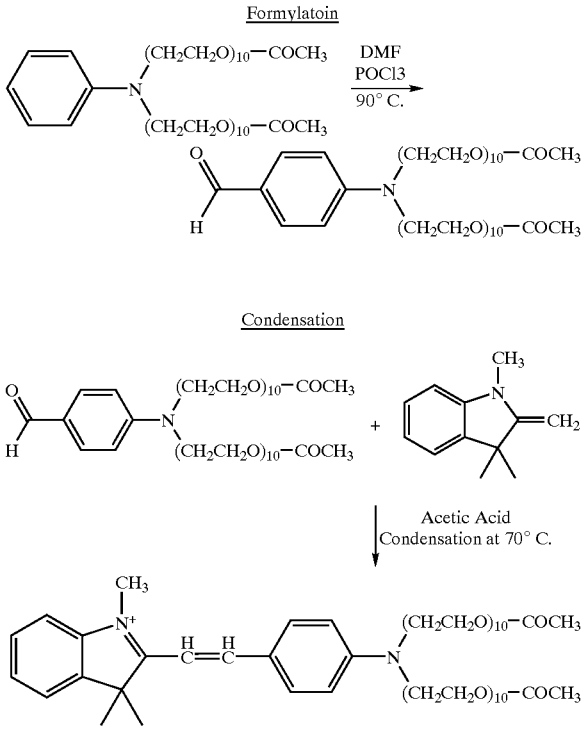

Thus, initially, an aniline including an aldehyde reactive group and poly(oxyalkylene) groups bonded through a linking group, here a nitrogen atom, is provided (such as disclosed within U.S. Pat. No. 4,877,411, Example 18, for example). The resultant aldehyde aniline compound is then reacted with Fisher's Base (as it is commonly referred to)(a.k.a., 2-methylene-1,3,3-trimethylindoline), to effectuate the needed condensation reaction generating the desired colorant and water. Alternatively, the linking group for the poly(oxyalkylene) group may be O or $SO_2$, or other like species.

Specifically, then, the preferred colorant of this invention is produced through the following method:

EXAMPLE 1

Twenty grams of Aniline (20 EO) diacetate were charged to a 1L 4-neck flask and heated to 50° C. while stirring. To that was added 19.5 grams of DMF and 1.4 acetic anhydride. The temperature was then kept between 40 and 50° C. for 2 more hours. To this composition was added 17.4 $POCl_3$ at a rate to keep the temperature from rising. Once the addition was complete, the temperature was elevated to 90° C. and held there for an hour-and-a-half. Subsequently, the resultant mixture was cooled to 40° C. and 240 grams of water were then added at a rate to keep the temperature below 50° C. After allowing the mixture to cool again to 40° C., 50% KOH (caustic) was then added (41.7 g) in order to adjust the pH to a level between 4.5 and 5.0. The reaction was then heated to 70° C., at which point the mixture was removed from heat, poured into a separatory funnel and allow to phase separate. The salt layer resulting therefrom was then drained, leaving the product layer of the formylation step.

Subsequently, 19 grams of Fisher's Base was then charged to the resultant product from above and the mixture was then heated to 50° C. Acetic acid (74 g) was then added to the reaction at a rate to keep the temperature below 60° C., after which the reaction was heated to 70° C. and held there for 2 hours. The reaction mixture was then cooled to 50° C. for 2 more hours, after which the absorptivity was measured to check for complete reaction of the two components. The resultant mixture was then neutralized to pH 4–5 with muriatic acid and provided a deep red liquid colorant.

Compositions Including the Colorants From the Examples Above

The colorant of EXAMPLE I was then introduced within different fabric softener compositions for coloration analysis and staining tests. Such compositions included the following:

| Component | Amount (in parts) |
|---|---|
| FORMULATION Y | |
| Accosoft ® 501 | 28.3 |
| CaCl2 (25% solution) | 2.5 |
| Water | 71.6 |
| FORMULATION Z | |
| Accosoft ® 808 | 10 |
| Water | 90 |

The colorant of EXAMPLE 1, above, as well as a number of comparative colorants, and also mixtures of the EXAMPLE I colorant and other colorants, were then each individually introduced within samples of the colorless FORMULATIONS A and B (concentrated commercial liquid rinse-cycle fabric softeners). The resultant compositions are listed in tabular form below with amounts (measured by weight of the total softener formulation) of colorants noted as well as CIELAB values provided for each, including the mixtures. For simplicity sake, the colorants added below comply with the following list (with the components of the mixtures listed in terms of the parts per hundred added of each; A–D and P–R produce a red or pink color; E–G and S–U produce an orange; and H–J and V–X produce a purple or violet):

A—EXAMPLE 1

B—50.1 parts of A plus 49.9 parts of Liquitint® Yellow LP, from Milliken & Company C—64.2 parts of A plus 35.8 part of Liquitint® Yellow LP D—89.6 parts of A plus 10.4 parts of Liquitint® Yellow LP E—25.4 parts of A plus 74.6 parts of Liquitint® Yellow LP F—34.7 parts of A plus 65.3 parts of Liquitint® Yellow LP G—25.6 parts of A plus 74.4 parts of Liquitint® Yellow LP H—81.7 parts of A plus 18.3 parts of Liquitint® Violet LS, from Milliken & Company I—58.5 parts of A plus 41.5 parts of Liquitint® Violet LS J—96.6 parts of A plus 3.4 parts of Liquitint® Violet LS K—Acid Red 52

L—Liquitint® Pink, from Milliken & Company

M—Liquitint® Crimson, from Milliken & Company

N—FD&C Red 40

O—Acid Red 1

P—71.4 parts of N and 28.6 parts of Acid Yellow 23

Q—63.3 parts of O and 36.7 parts of Acid Yellow 23

R—90.2 parts of O and 9.8 parts of Acid Yellow 23

S—29.9 parts of K and 70.1 parts of Acid Yellow 23

T—36.3 parts of N and 63.7 parts of Acid Yellow 23

U—31.4 parts of N and 68.6 parts of Acid Yellow 23

V—84.7 parts of K and 15.3 parts of Acid Blue 9

W—70.4 parts of K and 29.6 parts of Acid Blue 9

X—98.5 parts of K and 1.5 parts of Acid Blue 9

TABLE 1

Types of Colorants Added and Resultant CIELAB Measurements

| | | | | CIELAB Values | | | | |
|---|---|---|---|---|---|---|---|---|
| Ex. # | Colorant(s) | Total Amount | Softener (from above) | L | C | h | a | b |
| 2 | A | 0.01% | Z | 47.36 | 32.47 | 335.06 | 29.437 | −13.69 |
| 3 | A | 0.025% | Z | 41.83 | 35.61 | 342.31 | 33.924 | −10.82 |
| 4 | A | 0.05% | Z | 37.96 | 33.89 | 348.90 | 33.26 | −6.528 |
| 5 | A | 0.10% | Z | 35.04 | 30.61 | 354.90 | 30.49 | −2.722 |
| 6 | A | 0.11% | Y | 66.84 | 38.55 | 344.20 | 37.10 | −10.50 |
| 7 | A | 0.01% | Y | 82.56 | 12.57 | 337.4 | 11.60 | −4.84 |
| 8 | A | 0.025% | Y | 78.41 | 20.42 | 339.7 | 19.15 | −7.069 |
| 9 | A | 0.05% | Y | 73.75 | 28.51 | 341.6 | 27.05 | −9.013 |
| 10 | A | 0.10% | Y | 65.44 | 40.63 | 344.4 | 39.13 | −10.93 |
| 11 | B | 0.16% | Z | 66.26 | 37.95 | 48.50 | 25.15 | 28.42 |
| 12 | C | 0.14% | Z | 65.99 | 34.52 | 38.69 | 29.95 | 21.58 |
| 13 | D | 0.11% | Z | 66.99 | 31.15 | 6.782 | 30.94 | 3.679 |
| 14 | E | 0.20% | Z | 68.00 | 44.69 | 63.26 | 20.11 | 39.91 |
| 15 | F | 0.13% | Z | 70.43 | 38.27 | 63.01 | 17.37 | 34.10 |
| 16 | G | 0.12% | Z | 72.94 | 39.60 | 72.00 | 12.24 | 37.67 |
| 17 | H | 0.04% | Z | 60.46 | 35.45 | 298.0 | 14.66 | −31.96 |
| 18 | I | 0.11% | Z | 43.27 | 54.67 | 298.4 | 21.22 | −53.13 |
| 19 | J | 0.12% | Z | 58.38 | 37.14 | 321.6 | 26.3 | −22.04 |
| (Comparatives) | | | | | | | | |
| 20 | K | 0.001% | Z | 54.02 | 32.48 | 330.5 | 28.25 | −16.02 |
| 21 | K | 0.0025% | Z | 50.99 | 41.22 | 336.4 | 37.77 | −16.51 |
| 22 | L | 0.02% | Z | 39.02 | 34.74 | 321.9 | 27.33 | −21.46 |
| 23 | L | 0.03% | Z | 37.31 | 34.57 | 324.5 | 28.14 | −20.09 |
| 24 | M | 0.015% | Z | 50.26 | 15.09 | 13.55 | 14.67 | 3.535 |
| 25 | M | 0.03% | Z | 46.94 | 21.13 | 21.49 | 19.67 | 7.741 |
| 26 | N | 0.005% | Z | 43.69 | 27.39 | 20.03 | 25.73 | 9.381 |
| 27 | N | 0.01% | Z | 41.20 | 28.72 | 23.71 | 26.29 | 11.55 |
| 28 | O | 0.005% | Z | 42.65 | 32.86 | 341.6 | 31.18 | −10.38 |
| 29 | O | 0.01% | Z | 39.13 | 32.21 | 347.7 | 31.48 | −6.852 |
| 30 | K | 0.01% | Z | 67.27 | 61.09 | 342.6 | 59.72 | −17.58 |
| 31 | K | 0.001% | Y | 79.84 | 29.23 | 337.4 | 26.98 | −11.24 |
| 32 | K | 0.0025% | Y | 75.28 | 42.72 | 339.0 | 39.87 | −15.34 |
| 33 | L | 0.02% | Y | 67.61 | 32.89 | 326.65 | 27.47 | −18.08 |
| 34 | L | 0.03% | Y | 64.06 | 36.88 | 327.7 | 31.17 | −19.71 |
| 35 | M | 0.015% | Y | 77.51 | 18.59 | 12.49 | 18.15 | 4.021 |
| 36 | M | 0.03% | Y | 73.94 | 24.77 | 14.49 | 23.98 | 6.197 |
| 37 | N | 0.005% | Y | 79.84 | 29.23 | 337.4 | 26.98 | −11.24 |
| 38 | N | 0.01% | Y | 71.97 | 32.99 | 19.67 | 31.07 | 11.11 |
| 39 | O | 0.005% | Y | 70.88 | 35.91 | 348.7 | 35.22 | −7.029 |
| 40 | O | 0.01% | Y | 65.74 | 43.47 | 351.9 | 43.04 | −6.093 |
| 41 | P | 0.015% | Z | 65.82 | 46.99 | 36.37 | 36.46 | 19.10 |
| 42 | Q | 0.015% | Z | 64.12 | 41.83 | 25.52 | 36.06 | 13.12 |
| 43 | R | 0.02% | Z | 60.20 | 47.32 | 6.99 | 45.2 | 4.47 |
| 44 | S | 0.03% | Z | 62.93 | 54.52 | 49.12 | 33.69 | 24.77 |

TABLE 1-continued

Types of Colorants Added and Resultant CIELAB Measurements

| Ex. # | Colorant(s) | Total Amount | Softener (from above) | CIELAB Values L | C | h | a | b |
|---|---|---|---|---|---|---|---|---|
| 45 | T | 0.03% | Z | 64.73 | 57.54 | 50.59 | 34.89 | 26.53 |
| 46 | U | 0.03% | Z | 65.28 | 59.99 | 53.66 | 33.95 | 28.13 |
| 47 | V | 0.01% | Z | 55.97 | 47.93 | 313.1 | 29.53 | −36.13 |
| 48 | W | 0.02% | Z | 49.51 | 47.69 | 300.9 | 20.72 | −43.26 |
| 49 | X | 0.009% | Z | 65.65 | 54.55 | 335.7 | 49.45 | −21.98 |

These inventive and comparative formulations were then tested on various fabric types through a test designed to mimic a worst-case scenario of a consumer leaving the fabric softener formulation in contact with a wet garment for a long period of time. The test was basically as follows:

Two multifiber strips (each approximately 6 inches wide and four inches long, with each individual fiber strip approximately three-quarters of an inch in width; the individual fibers were spun acetate, bleached cotton, spun nylon, spun Dacron® polyester Type 54, spun Dralon® acrylic, and worsted wool, all white in color originally) and one strip (of similar width and length to the multistrip above) of terry cotton were soaked (immersed) for 15 minutes within the test formulation. The fabric strips were then each individually passed through a nip roller (36 psi) to give uniform wet pick-up of the colored product, and then dried on a drying rack at room temperature overnight. Subsequently, the strips were then rinsed to remove any excess colored formulation therefrom and then soaked in 400 mL water (at room temperature) for 6 to 8 hours (with the water changed several times once the water became too cloudy to see the bottom of the vessel). The strips were then again air-dried and visually rated using the AATCC Gray Scale For Evaluating Staining by giving two sets of treated strips to two different people for individual evaluations, along with a control strip of uncolored product. The evaluators then compared the control with the treated strips and assigned individual numerical values for staining levels, with 1 being the highest degree of staining and 5 being the absolute lowest (substantially non-stained). A 4 rating indicates nearly non-stained, while 3 or lower indicates clear staining is evident, with a 2 evincing a greater degree of staining thereon. The results were as follows:

TABLE 2

Staining Levels of Inventive and Comparative Formulations
Stain Test Results

| Ex. # | T. Cotton | Acetate | Bl. Cotton | Nylon | Poly-ester | Acrylic | Wool |
|---|---|---|---|---|---|---|---|
| 2 | 5 | 4–5 | 5 | 5 | 5 | 5 | 5 |
| 3 | 4–5 | 3 | 4–5 | 4 | 5 | 5 | 5 |
| 4 | 4–5 | 3 | 4–5 | 4 | 5 | 5 | 4 |
| 5 | 4–5 | 2–3 | 4–5 | 4 | 5 | 5 | 3 |
| 6 | 4–5 | 4 | 4–5 | 5 | 5 | 5 | 4 |
| 7 | 5 | 5 | 5 | 5 | 5 | 5 | 5 |
| 8 | 5 | 4–5 | 5 | 5 | 5 | 5 | 5 |
| 9 | 5 | 4 | 5 | 5 | 5 | 5 | 5 |
| 10 | 4–5 | 3–4 | 4–5 | 5 | 5 | 5 | 5 |
| 11 | 4 | 3 | 4 | 5 | 5 | 5 | 4.5 |
| 12 | 4 | 3.5 | 4.5 | 5 | 5 | 5 | 4.5 |
| 13 | 4 | 4 | 4 | 5 | 5 | 5 | 4 |
| 14 | 4 | 3 | 4.5 | 5 | 5 | 5 | 4.5 |
| 15 | 4.5 | 3.5 | 4.5 | 5 | 5 | 5 | 4.5 |
| 16 | 4.5 | 3.5 | 4.5 | 5 | 5 | 5 | 4 |
| 17 | 5 | 4.5 | 5 | 5 | 5 | 5 | 5 |

TABLE 2-continued

Staining Levels of Inventive and Comparative Formulations
Stain Test Results

| Ex. # | T. Cotton | Acetate | Bl. Cotton | Nylon | Poly-ester | Acrylic | Wool |
|---|---|---|---|---|---|---|---|
| 18 | 2.5 | 4 | 3 | 5 | 5 | 5 | 5 |
| 19 (Comparatives) | 4.5 | 4 | 4.5 | 5 | 5 | 5 | 4.5 |
| 20 | 3–4 | 5 | 4 | 5 | 5 | 5 | 5 |
| 21 | 2–3 | 5 | 3 | 5 | 5 | 5 | 5 |
| 22 | 2–3 | 5 | 4 | 5 | 5 | 5 | 5 |
| 23 | 2 | 5 | 2 | 5 | 5 | 5 | 5 |
| 24 | 3–4 | 5 | 4 | 5 | 5 | 5 | 5 |
| 25 | 2–3 | 5 | 3 | 5 | 5 | 5 | 5 |
| 26 | 3–4 | 5 | 4 | 5 | 5 | 5 | 5 |
| 27 | 2–3 | 5 | 3 | 5 | 5 | 5 | 5 |
| 28 | 3 | 5 | 3–4 | 5 | 5 | 5 | 5 |
| 29 | 1–2 | 5 | 1–2 | 5 | 5 | 5 | 5 |
| 30 | 3 | 5 | 3–4 | 5 | 5 | 5 | 5 |
| 31 | 3–4 | 5 | 4 | 5 | 5 | 5 | 5 |
| 32 | 2–3 | 5 | 3 | 5 | 5 | 5 | 5 |
| 33 | 2–3 | 5 | 2–3 | 5 | 5 | 5 | 5 |
| 34 | 2 | 5 | 2 | 5 | 5 | 5 | 5 |
| 35 | 3–4 | 5 | 4 | 5 | 5 | 5 | 5 |
| 36 | 2–3 | 5 | 3 | 5 | 5 | 5 | 5 |
| 37 | 3 | 5 | 3 | 5 | 5 | 5 | 5 |
| 38 | 1–2 | 5 | 5 | 5 | 5 | 5 | 5 |
| 39 | 3 | 5 | 3–4 | 5 | 5 | 5 | 5 |
| 40 | 2 | 5 | 2–3 | 5 | 5 | 5 | 5 |
| 41 | 2 | 5 | 2–3 | 5 | 5 | 5 | 5 |
| 42 | 1 | 4–5 | 1–2 | 5 | 5 | 3–4 | 4 |
| 43 | 2–3 | 5 | 3 | 5 | 5 | 4.5 | 5 |
| 44 | 3 | 5 | 3 | 5 | 5 | 5 | 5 |
| 45 | 2–3 | 5 | 2–3 | 5 | 5 | 5 | 5 |
| 46 | 2 | 5 | 2 | 5 | 5 | 5 | 5 |
| 47 | 1–2 | 5 | 2–3 | 5 | 5 | 4–5 | 4–5 |
| 48 | 1 | 5 | 1–2 | 5 | 5 | 4 | 4–5 |
| 49 | 1 | 5 | 2 | 5 | 5 | 4–5 | 4–5 |

It is thus evident that the formulations comprising the inventive red colorants alone and thus exhibiting excellent high red visible color space characteristics also exhibit greater versatility in terms of low staining propensities over a wide array of different fabrics, most notably terry cottons, than the comparatives red colorants. Also, the mixtures comprising such hemicyanine derivative colorants also exhibit excellent colorations (orange, red or pink, or purple or violet, as examples) and exhibit great versatility in terms of low-staining over a myriad of different fabrics as well, particularly as compared with similarly colored mixtures of colorants.

There are, of course, many alternative embodiments and modifications of the present invention which are intended to be included within the spirit and scope of the following claims.

What I claim is:

1. A liquid fabric softener composition comprising at least one fabric softening component and at least one red polymeric hemicyanine colorant.

2. The liquid fabric softener composition of claim 1 wherein at least one coloring agent, other than said at least one red hemicyanine derivative colorant, is present.

3. The liquid fabric softener composition of claim 2 wherein said polymeric colorant comprises at least one poly(oxyalkylene) chain thereon.

4. The liquid fabric softener composition of claim 3 wherein said polymeric colorant conforms with the following formula (I)

(I)

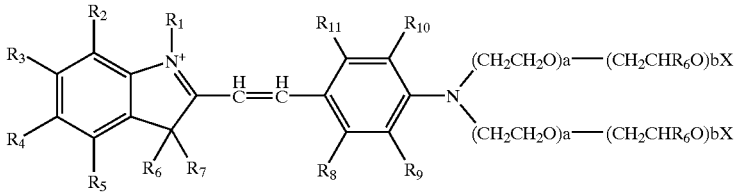

wherein $R_1$ is H or $C_1$–$C_{20}$ alkyl; $R_2$, $R_3$, $R_4$, $R_5$, $R_6$, $R_7$, $R_8$, $R_9$, $R_{10}$, and $R_{11}$ are the same or different and are selected from the group consisting of H, $C_1$–$C_{20}$ alkyl, $C_1$–$C_{20}$ alkoxy, $C_1$–$C_{20}$ hydroxyl, amino, hydroxyl, and $C_1$–$C_{20}$ carboxyl; R' is $C_1$–$C_{16}$ alkyl; a is 0–200 and b is 0–200, wherein a+b≧3; X is H or $COCH_3$; and any counter ion may be present, such as, without limitation, $OH^-$, $Cl^-$, $CH_3COO^-$, or $HSO_4^{31}$ .

5. The liquid fabric softener of claim 4 wherein $R_1$ and $R_6$ are methyl and the remaining groups $R_2$, $R_3$, $R_4$, $R_5$, $R_7$, $R_8$, $R_9$, $R_{10}$, and $R_{11}$ are hydrogen, and further wherein a is about 20, b is 0, X is $COCH_3$, and the counter ion is $OH^-$.

6. The liquid fabric softener composition of claim 5 wherein said polymeric colorant comprises at least one poly(oxyalkylene) chain thereon.

7. The liquid fabric softener composition of claim 6 wherein said polymeric colorant conforms with the following formula (I)

(I)

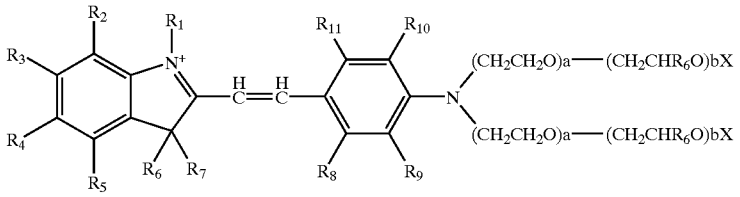

wherein $R_1$ is H or $C_1$–$C_{20}$ alkyl; $R_2$, $R_3$, $R_4$, $R_5$, $R_6$, $R_7$, $R_8$, $R_9$, $R_{10}$, and $R_{11}$ are the same or different and are selected from the group consisting of H, $C_1$–$C_{20}$ alkyl, $C_1$–$C_{20}$ alkoxy, $C_1$–$C_{20}$ hydroxyl, amino, hydroxyl, and $C_1$–$C_{20}$carboxyl; R' is $C_1$–$C_{16}$ alkyl; a is 0–200 and b is 0–200, wherein a+b≈3; X is H or $COCH_3$; and any counter ion may be present, such as, without limitation, $OH^-$, $Cl^-$, $CH_3COO^-$, or $HSO_4^-$.

8. The liquid fabric softener composition of claim 7 wherein $R_1$ and $R_6$ are methyl and the remaining groups $R_2$, $R_3$, $R_4$, $R_5$, $R_7$, $R_8$, $R_9$, $R_{10}$, and $R_{11}$ are hydrogen, and further wherein a is about 20, b is 0, X is $COCH_3$, and the counter ion is $OH^-$.

9. A method of conditioning fabrics comprising the steps of (a) providing a fabric; and (b) contacting said fabric with the liquid fabric softener composition of claim 1.

10. A method of conditioning fabrics comprising the steps of (a) providing a fabric; and (b) contacting said fabric with the liquid fabric softener composition of claim 2.

11. A method of conditioning fabrics comprising the steps of (a) providing a fabric; and (b) contacting said fabric with the liquid fabric softener composition of claim 3.

12. A method of conditioning fabrics comprising the steps of (a) providing a fabric; and (b) contacting said fabric with the liquid fabric softener composition of claim 4.

13. A method of conditioning fabrics comprising the steps of (a) providing a fabric; and (b) contacting said fabric with the liquid fabric softener composition of claim 5.

14. A method of conditioning fabrics comprising the steps of (a) providing a fabric; and (b) contacting said fabric with the liquid fabric softener composition of claim 6.

15. A method of conditioning fabrics comprising the steps of (a) providing a fabric; and (b) contacting said fabric with the liquid fabric softener composition of claim 7.

16. A method of conditioning fabrics comprising the steps of (a) providing a fabric; and (b) contacting said fabric with the liquid fabric softener composition of claim 8.

17. The method of claim 9 wherein step (b) occurs during an aqueous rinsing cycle within a standard rotary laundering machine.

18. A liquid formulation comprising at least one cationic quaternary ammonium compound and at least one red olymeric hemicyanine colorant.

19. The liquid formulation of claim 18 wherein said polymeric hemicyanine colorant conforms with the following formula (I)

(I)

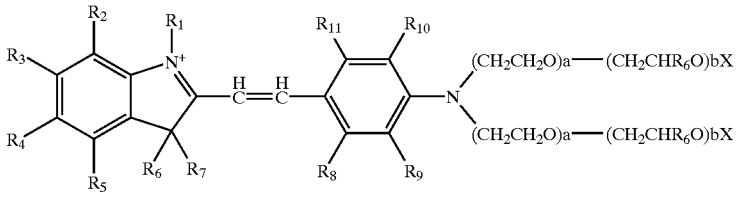

Hemicyanine Polymeric Colorant wherein $R_1$ is H or $C_1$–$C_{20}$ alkyl; $R_2$, $R_3$, $R_4$, $R_5$, $R_6$, $R_7$, $R_8$, $R_9$, $R_{10}$, and $R_{11}$ are the same or different and are selected from the group consisting of H, $C_1$–$C_{20}$ alkyl, $C_1$–$C_{20}$ alkoxy, $C_1$–$C_{20}$ hydroxyl, amino, hydroxyl, and $C_1$–$C_{20}$ carboxyl; R' is $C_1$–$C_{16}$ alkyl; a is 0–200 and b is 0–200, wherein a+b>3; X is H or $COCH_3$; and any counter ion may be present, such as, without limitation, $OH^-$, $Cl^-$, $CH_3COO^-$, or $HSO_4^-$.

20. The liquid formulation of claim 19 wherein $R_1$ and $R_6$ are methyl and the remaining groups $R_2$, $R_3$, $R_4$, $R_5$, $R_7$, $R_8$, $R_9$, $R_{10}$, and $R_{11}$ are hydrogen, and further wherein a is about 20, is 0, X is $COCH_3$, and the counter ion is $OH^-$.

* * * * *

UNITED STATES PATENT AND TRADEMARK OFFICE

CERTIFICATE OF CORRECTION

PATENT NO. : 6,593,289 B1
DATED : July 15, 2003
INVENTOR(S) : Stravrakas, James E.

It is certified that error appears in the above-identified patent and that said Letters Patent is hereby corrected as shown below:

Column 15,
Line 56, after the letters "a+b", delete the symbol "=" and insert the symbol -- ≧ --.

Column 16,
Line 62, after the word "red", delete the letters "oly-" and insert the letters -- poly- --.

Column 17,
Line 19, after the letters "a+b", delete the symbol ">" and insert the symbol -- ≧ --.

Signed and Sealed this

Third Day of May, 2005

JON W. DUDAS
*Director of the United States Patent and Trademark Office*